United States Patent [19]

Parisotto

[11] 4,391,049

[45] Jul. 5, 1983

[54] COVERING ELEMENT OR TONGUE FOR ROCK-CLIMBING AND SIMILAR SPORT BOOTS

[75] Inventor: Francesco Parisotto, Asolo, Italy

[73] Assignee: CALZATURIFICIO S.C.A.R.P.A. S.n.c. di Parisotto Francesco & C., Italy

[21] Appl. No.: 229,949

[22] Filed: Jan. 30, 1981

[30] Foreign Application Priority Data

Feb. 12, 1980 [IT] Italy ..... 20768/80[U]

[51] Int. Cl.[3] ..... A43B 5/04; A43B 23/26

[52] U.S. Cl. ..... 36/114; 36/54; 36/120

[58] Field of Search ..... 36/114, 117, 120, 50, 36/54

[56] References Cited

U.S. PATENT DOCUMENTS

| | | | |
|---|---|---|---|
| 3,792,537 | 2/1974 | Plank et al. | 36/120 |
| 3,820,256 | 6/1974 | Schoch | 36/120 |
| 3,936,959 | 2/1976 | Hanson et al. | 36/117 |
| 4,099,341 | 7/1978 | Gibson | 36/120 |

*Primary Examiner*—Patrick D. Lawson

*Attorney, Agent, or Firm*—Steinberg & Raskin

[57] ABSTRACT

Covering element or tongue for rock-climbing, mountain skying and similar sport boots comprising a single, shaped laminar element divided into first and second parts, an end of one part being relatively slidable or longitudinally moveable with respect to an opposite end of the other part to impart an improved flexibility to the covering element or tongue. In a preferred embodiment, the end of one part is connected to an opposite end of the other part by hinge structure formed by a partly notched intermediate zone of the covering element and so that one end region of one part is superimposed over an end region of the other part.

5 Claims, 5 Drawing Figures

COVERING ELEMENT OR TONGUE FOR ROCK-CLIMBING AND SIMILAR SPORT BOOTS

BACKGROUND OF THE INVENTION

This patent for industrial invention is concerned with a covering element or tongue for rock-climbing, mountain skying and similar sport boots, the latter being hereinafter referred to as "mountain boots".

For commercial reasons, it is a common practice to make mountain boots of plastics material which include an external element, of laminar plastics material and forming an integral part of the mountain boot, so shaped as to cover the openings of the boot when it is tied.

In order to give an increased foot adaptability to a particular type of mountain boot so as to permit a flexure thereof at the instep, a bootleg portion is hingedly connected to the body portion of the boot.

However, such a solution is not completely satisfactory since the flexibility provided by such a hinging of the bootleg to the body is considerably offset by the rigidity of the tongue or covering element.

SUMMARY OF THE INVENTION

It is the object of the present invention to provide a new and improved covering element or tongue which is shaped to permit a flexure thereof, and this to substantial benefit relative to conventional mountain boots since a boot provided with a tongue or covering element according to the present invention is especially adapted to various intended uses (e.g., rock, mountain skying and similar sports).

This and further objects of the invention will become apparent to those skilled in the art from the following description and claims.

According to the invention, the tongue or covering element for rock-climbing, mountain skying and similar sport boots, is essentially characterized by comprising a single, shaped laminar element divided into first and second parts, an end of one part being relatively slidable or longitudinally moveable with respect to an opposite end of the other part. In a preferred embodiment, the end of one part is connected to an opposite end of the other part by hinge structure formed by a partly notched intermediate zone of the covering element and so that the end region of one part is superimposed over an end region of the other part.

DESCRIPTION OF THE DRAWINGS

A preferred embodiment of the invention is shown by way of unrestrictive example in the figures of the accompanying drawings, in which.

Figure 1:
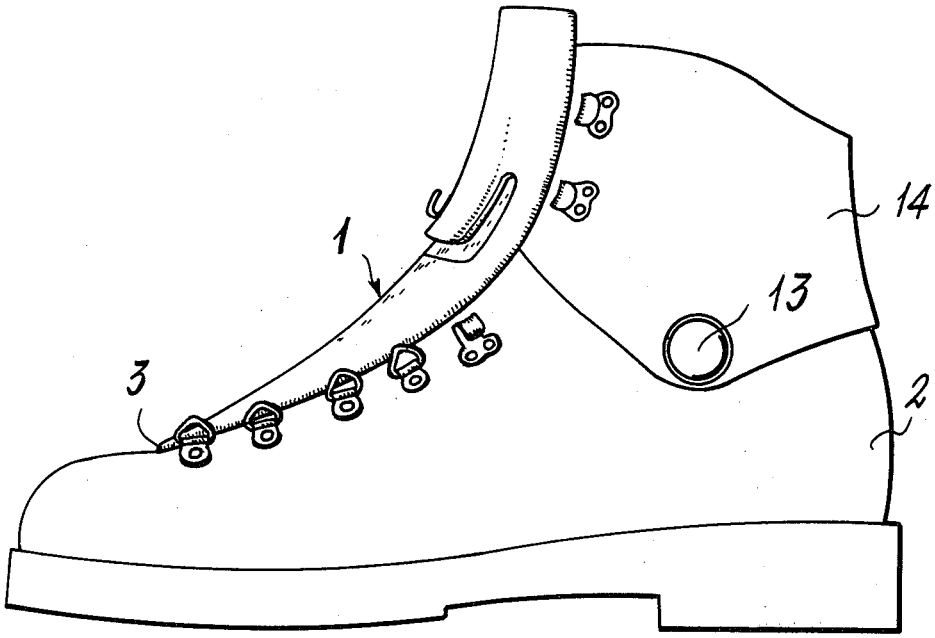
FIG. 1 is a side view of a mountain boot provided with the covering element according to the invention.
Figure 2:
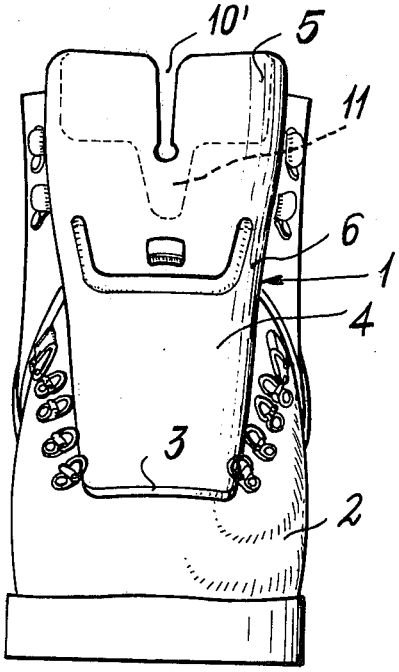
FIG. 2 is a front view of the boot shown in FIG. 1.

Referring to the figures of the accompanying drawings, a covering element, generally indicated at 1, is made of plastics material, of arcuate shape and forms an integral part of a boot 2, also made of plastics material, being secured thereto by its transverse edge 3. The boot body 2 and covering element 1 are preferably provided in a single moulding operation.

According to the invention, the covering element 1 substantially comprises a first lower part 4 and a second upper part 5, said lower part 4 terminating at its lower end with the above mentioned edge 3 for connection to the boot 2.

Figure 3:
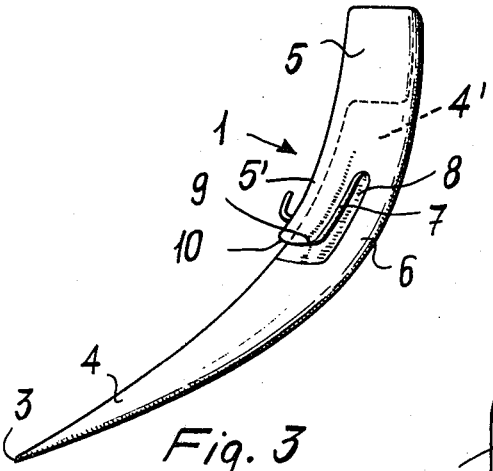
FIG. 3 is a side view of the covering element only.
Figure 4:
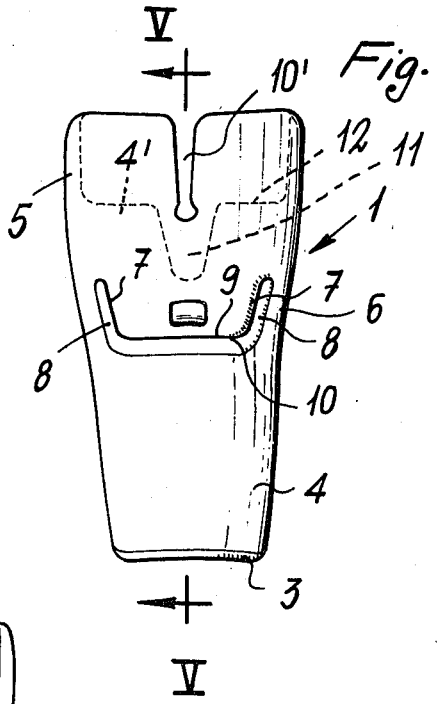
FIG. 4 is a front view of the covering element shown in FIG. 3.
Figure 5:
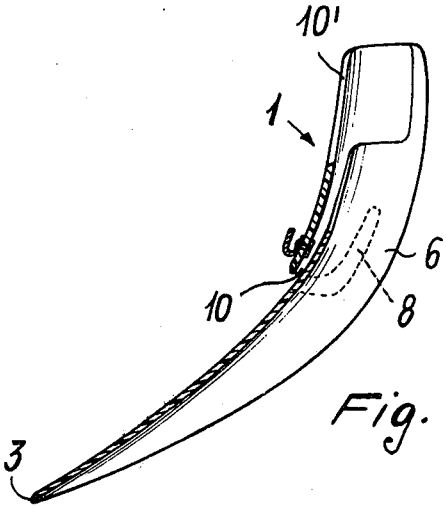
FIG. 5 is a sectional view taken along line V—V of FIG. 4.

As particularly shown in FIGS. 3, 4 and 5, the upper part 5 overlies so as to be superimposed to some extent over said lower part 4, the upper and lower parts being interconnected by side strips 6 forming as a whole a hinge for the bending of said element 1. More particularly, the end section 5' of part 5 overlying the end section 4' of part 4 has edges 7 forming with the internal edges of side strips 6 two side slits 8, and a transverse edge 9 forming with the underlying part 5 a transverse slit 10. The end edge of part 5 opposite to edge 9 has an axial notch 10' for giving along with a similar axial notch 11 on edge 12 of part 4 opposite to edge 3 a larger extent of flexibility to said covering element 1.

In possible modified embodiments (not shown), the end edge of part 5 overlying part 4 may be connected to the latter through a short central section, and the superimposition of said two parts 4 and 5 can be inverted, in that part 4 will overlie said part 5 to allow a relative sliding between the two parts, while said covering element 1 comprising a single shaped piece.

From the foregoing it clearly appears that the flexure given to boot 2 by conventional articulated joints 13 provided on bootleg 14 (FIG. 1) is added by the flexibility of covering element 1, so as to give the desired increased adaptability of boot 2 to the several intended uses, and this differently from what is the case of boots provided with not flexible covering element.

What is claimed is:

1. A covering element or tongue for rock-climbing and similar sport boots, comprising:

a single, shaped laminar element divided into first and second parts, one end of one part being connected to an opposite end of the other part by hinge means formed by a partly notched intermediate zone of the covering element, and wherein one end region of one part overlies and is superimposed over an end region of the other part so that said one end of one part is relatively slidable or longitudinally moveable with respect to said opposite end of the other part, whereby an improved flexibility is imparted to the covering element.

2. The combination according to claim 1 wherein the laminar element is divided into upper and lower parts interconnected by by side strips, and wherein a lower end region of said upper part overlies and is superimposed over an upper end region of said lower part, and whereby said upper part has lower edges which define a slit with said side strips and underlying upper end region of said lower part.

3. A covering element according to claim 1, characterized in that said first and second parts are hingedly interconnected at side zones of the covering element.

4. A covering element according to claim 1, characterized in that said first and second parts are interconnected at a central zone of the covering element.

5. A covering element according to claim 1, characterized in that at least one of said first and second parts has an axial notch from a transverse edge.

* * * * *